United States Patent [19]

Wilson

[11] 4,056,927

[45] Nov. 8, 1977

[54] TIME GIVING DEVICE

[76] Inventor: James R. Wilson, 2050 Kiva Road, Santa Fe, N. Mex.

[21] Appl. No.: 785,350

[22] Filed: Apr. 7, 1977

[51] Int. Cl.[2] ..... G04B 19/22

[52] U.S. Cl. ..... 58/44; 58/50 R; 35/46 R

[58] Field of Search ..... 58/42.5, 43, 44, 50 R, 58/125 R, 125 B, 126 A, 126 E; D10/10; 35/46 R

[56] References Cited

U.S. PATENT DOCUMENTS

| | | | |
|---|---|---|---|
| D. 127,848 | 6/1941 | Tigerman et al. | D10/10 |
| D. 242,434 | 11/1976 | Knowles | D10/10 |
| 1,553,222 | 9/1925 | Denoyer | 58/44 |
| 2,223,605 | 12/1940 | Dupler | 58/44 |
| 2,300,621 | 11/1942 | Dupler | 58/44 |
| 3,292,361 | 12/1966 | Redmond | 58/44 |
| 3,348,321 | 10/1967 | Cunningham | 58/44 X |
| 3,370,415 | 2/1968 | McIlvaine | 58/44 |
| 3,516,243 | 6/1970 | Hazard | 58/44 |
| 3,527,046 | 9/1970 | Pawl | 58/44 |
| 3,583,150 | 6/1971 | Falk | 58/44 |

*Primary Examiner*—Ulysses Weldon
*Attorney, Agent, or Firm*—Allen D. Brufsky

[57] ABSTRACT

A globe construction for visually determining the time at a geographical area of the earth including a translucent globe, a rotatable hour dial labelled by hours and having perforations through which a stationary dial having minute indicia is viewable through the rotatable dial. The rotatable dial is activated by a timing motor adapted to rotate the hour dial 360° per 24 hour day. The interior of the globe is provided with a light to permit viewing the hour indicia on the hour dial and the indicia on the stationary minute dial.

4 Claims, 3 Drawing Figures

TIME GIVING DEVICE

PRIOR ART

The following U.S. Pat. Nos. are considered pertinent in that they show global clocks: D 127,848, 3,370,415, 1,553,222, 3,516,243, 3,292,361, 3,527,046, 3,348,321, 3,583,150, 3,827,233.

BACKGROUND OF THE INVENTION

This invention relates to a globe construction adapted to permit determination of the time in any geographical area of the globe.

Many persons find it desirable to determine the time in any geographical area of the globe. Presently available clocks generally are capable of giving the time in only one time zone and the viewer must compute the time in by adding or subtracting hours from the local time. It would be desirable to provide a clock from which a person can instantly determine the time in a given time zone, particularly for persons who often travel and/or who frequently telephone persons in other areas of the globe.

It is an object of this invention to provide a world time clock.

It is a further object of this invention to provide a clock which permits the use to determine the time on any area of the globe without the need for computations.

Further objects of this invention will become evident in view of the following detailed disclosure.

SUMMARY OF THE INVENTION

The present invention provides a world clock comprising a clear transparent globe marked to outline the boundaries of the countries. The inside surface of the globe is tinted in the form of colored strips which correspond to specific time zones on the earth. A cylindrical light is positioned within the globe generally along the north-south axis of the globe. A motor is mounted on the cylindrical light which is adapted to rotate a curved plate within the globe 360° every 24 hour day. The curved plate is marked with twin sets of numbers, each ranging from 1 to 12 such that 1 set represents day-time and the other set represents night-time. The curved plate also has 24 perforations each associated with a number of the plate to permit viewing of a ring positioned in the globe and below the plate. The ring has numbered indicia representing minute segments of time so that the viewer can determine the hour and minute time on any area of the globe.

DETAILED DESCRIPTION OF THE PREFERRED EMBODIMENTS

Figure 1:
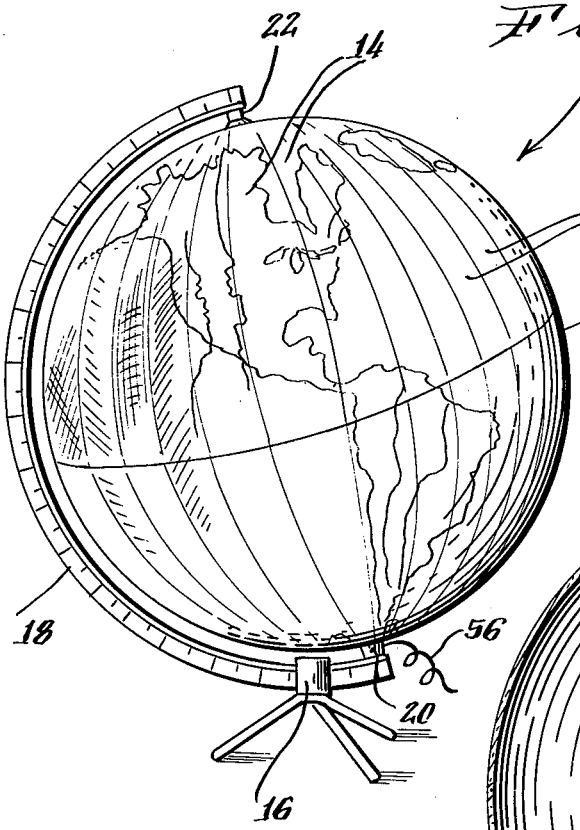
FIG. 1 is a side view of the clock of this invention.

Referring to the figures, the clock 10 comprise a globe 12 formed of transparent material which is tinted to form 24 strips 14 each representing a time zone on the earth. The globe 12 also is marked to show the outline of the countries of the earth. The globe 10 is mounted on support 16 which is connected to curved plate 18 that extends between the North and South Poles of the globe 12. The curved plate 18 is secured to globe supports 20 and 22.

Figure 2:
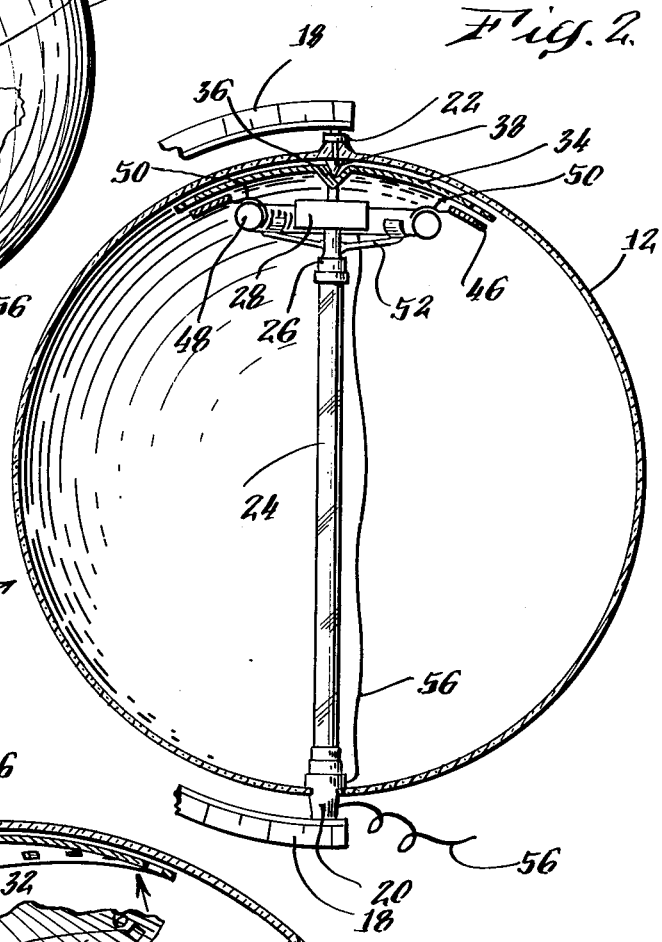
FIG. 2 is a cross-sectional view of the clock of FIG. 1.
Figure 3:
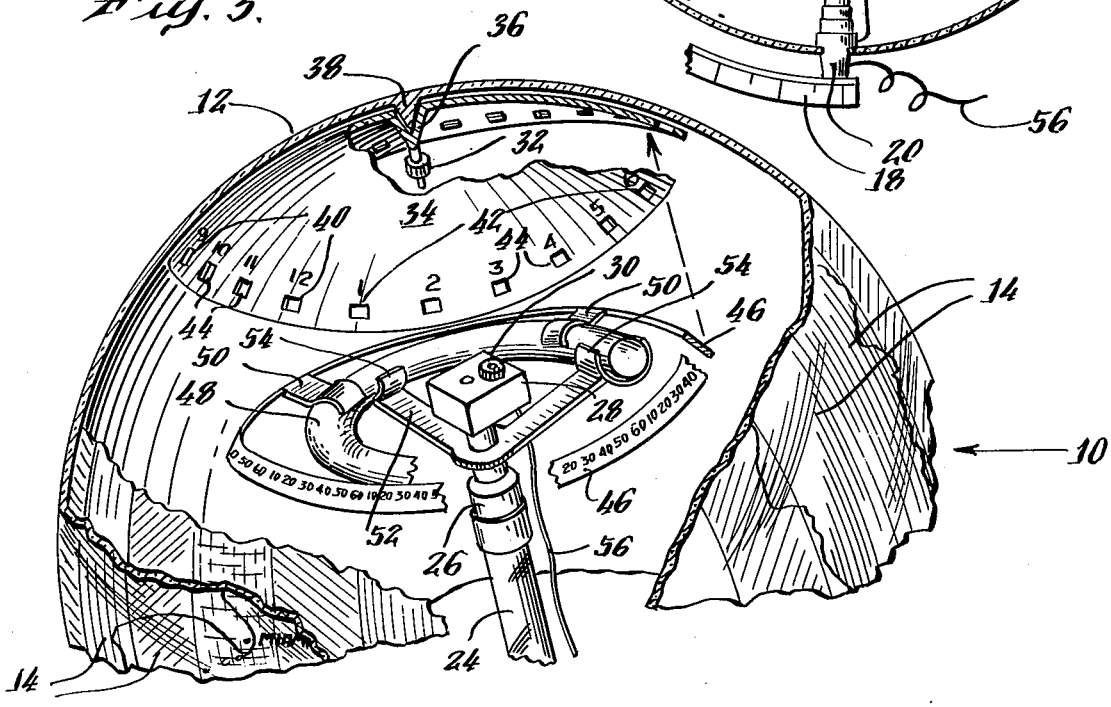
FIG. 3 is a partial cross-sectional exploded view of the top portion of the clock of FIG. 1.

As shown in FIGS. 2 and 3, a cylindrical light 24 is attached to support 20 and at the other end is attached to a motor support 26. A motor 28 is mounted on motor support 26 and include a powered gear 30 which meshes with gear 32 mounted on curved plate 34. Plate 34 includes an indentation 36 which cooperates with pivot 38 of globe 12 so that plate 34 rotates 360° every 24 hours. The plate 34 is provided with two sets of numbers, each set being 12 numbers with one set 40 representing the hours at daytime and the other set 42 representing the hours of night-time. The plate 34 is provided with perforations 44 through which the viewer can see ring 46 which has indicia representing minute time. Ring 46 is mounted on circular light 48 by clip 50. Light 48 is mounted on support 52 by clip 54. Appropriate electrical wing 56 is provided to power lights 24 and 48 and motor 28 to rotate plate 34.

With the apparatus described, the viewer can determine the time in any time zone by determining the number 40 or 42 in a given time zone 14 and by viewing the minute time on ring 46 through the perforation 44 positioned adjacent the number 40 or 42 in the time zone under consideration.

It is to be understood that this invention is not limited to the embodiments specifically described but includes modifications which will be obvious to the person skilled in the art.

What is claimed is:

1. Apparatus for determining the time on any geographical area of the earth which comprises a transparent globe segmented into time zones, and an hour plate within said globe having numbers representing hours of the days, perforations on said plate each associated with one of said hour numbers, means within said globe positioned below said perforations for determining minute time, means for rotating said plate 360° every 24 hours and means for illuminating the interior of said globe.

2. The apparatus of claim 1 wherein the means for rotating said plate comprises a motor mounted on support means extending along the North-South axis within said globe.

3. The apparatus of claim 1 including a light positioned along the North-South axis within said globe and a circular light positioned below said plate in said globe.

4. The apparatus of claim 1 wherein said hour numbers comprise two sets of twelve numbers, are set representing the day time hours and the other set representing night-time hours.

* * * * *